US005632656A

United States Patent [19]

Lo

[11] Patent Number: 5,632,656

[45] Date of Patent: May 27, 1997

[54] EXPANDABLE SURFACE MOUNT BOX FOR TRANSMISSION LINE CONNECTORS

[76] Inventor: Jeffrey Lo, 11980 Telegraph Rd., #103, Santa Fe Springs, Calif. 90670

[21] Appl. No.: 550,539

[22] Filed: Oct. 30, 1995

[51] Int. Cl.[6] ..... H01R 23/02

[52] U.S. Cl. ..... 439/676; 439/717

[58] Field of Search ..... 439/676, 701, 439/717

[56] References Cited

U.S. PATENT DOCUMENTS

| | | | |
|---|---|---|---|
| 4,269,470 | 5/1981 | Ustin | 439/717 |
| 4,290,664 | 9/1981 | Davis et al. | 439/676 |
| 4,820,192 | 4/1989 | Dunkmann et al. | 439/676 |
| 5,098,316 | 3/1992 | Kollmann et al. | 439/717 |
| 5,370,541 | 12/1994 | Bossard | 439/676 |
| 5,391,095 | 2/1995 | Born | 439/676 |
| 5,431,586 | 7/1995 | Klas et al. | 439/717 |

FOREIGN PATENT DOCUMENTS

| | | | |
|---|---|---|---|
| 3627899 | 2/1988 | Germany | 439/717 |

*Primary Examiner*—Neil Abrams
*Assistant Examiner*—Brian J. Biggi
*Attorney, Agent, or Firm*—Michael D. Bednarek; Kilpatrick Stockton LLP

[57] ABSTRACT

A surface mount box including a substrate and a cover is disclosed. The substrate has four side walls on a rectangular base. Coupling means are formed on exterior surfaces of two of the side walls to connect with other surface mount boxes for expansion. An opening on one of the side walls provides a passage for a transmission line to go into the surface mount box. Another opening is formed on one of the side walls to receive a connector port. The cover has a number of coupling elements and a plug on a base plate. When the cover is fastened to the substrate by the coupling elements, the plug inserts into the opening for the transmission line and confines the transmission line within a small region.

20 Claims, 5 Drawing Sheets

EXPANDABLE SURFACE MOUNT BOX FOR TRANSMISSION LINE CONNECTORS

BACKGROUND OF THE INVENTION

1. Field of the Invention

The invention relates to an apparatus for containing transmission line connectors, and more specifically, to an expandable surface mount box for transmission line connectors.

2. Technical Backgrounds

High quality transmission lines have been provided for electrically connecting various electronic components to improve data transmission rates. A transmission line can be more adaptable if it is connected to the electronic components through connectors. The connectors include a first-type connector and a second-type connector. The transmission lines are connected to the electronic components by engaging the second-type connector with the first-type connector. That is, an electrical loop can be formed if the second-type connector is inserted into and received by the first-type connector.

FIG. 1 is a perspective view of a conventional two-port containing box 10 for transmission line connectors. The box is composed of a cover 12 and a substrate 14. Two ports 121 and 123 in a front end of the box are provided for holding two first-type connectors. Two windows 125 and 127 are formed, near the front end of the box, on the top surface of cover 12 for inserting cards which are provided for indicating various connector ports of the box.

A more detailed view of substrate 14 is illustrated in FIG. 2 whose horizontal direction has a 90° rotation from that shown in FIG. 1. Therefore, the opposite side of the front end, i.e., a rear end of the box, can be shown in the figure. Substrate 14 includes a plate and a number of short walls standing near edges of the plate. The short walls are provided for fastening side plates of the cover 12 when the cover 12 is engaged with the substrate 14. Two spaced posts 141 and 143 stand at edge center of the rear end of the plate to define a passage for a transmission line 147. A small cut 145*a* is formed at the plate edge between the two posts 141 and 143 to facilitate entering of transmission line 147 into the box.

However, the passage between posts 141 and 143 is not the only path by which transmission lines can go into the box. For example, the transmission line can go through the spacing between each post and its adjacent short wall. Therefore, when cover 12 is engaged with substrate 14 and the transmission lines do not go through the passage defined between the two posts, as is shown in FIG. 3, transmission lines 148 and 149 are pressed by rear-end side plate of cover 12 and substrate 14. The transmission lines crushed by side plate of cover 12 will be damaged, thus causing an open circuit in the transmission line.

Moreover, the conventional containing box cannot be expanded. That is, the box is provided with a fixed number of ports. For example, if an additional transmission line is introduced into a two-port box which has already been installed with two connectors for two transmission lines, the two-port box cannot accommodate the expansion. Therefore, a four-port box must be substituted for the two-port box which must then be subsequently discard.

SUMMARY OF THE INVENTION

Accordingly, a containing box having a unique passage for transmission lines is provided in the present invention to prevent the transmission lines from being crushed or damaged.

The present invention also provides a surface mount box which can be expanded by directly connecting with other surface mount boxes to have a desired number of connector ports.

The surface mount box of the present invention includes a substrate and a cover. The substrate has four side walls on a rectangular base. Coupling means are formed on exterior surfaces of two of the side walls to connect with other surface mount boxes for expansion. An opening on one of the side walls provides a passage for a transmission line to go into the surface mount box. Another opening is formed on one of the side walls to receive a connector port. The cover has a number of coupling elements and a plug on a base plate. When the cover is fastened to the substrate by the coupling elements, the plug inserts into the opening for transmission line and confines the transmission line within a small region. Therefore, the transmission line will not be crushed or damaged. The surface mount box according to the present invention can be easily expanded by directly connecting other boxes on side walls of the substrate. Furthermore, tabs can be adhered to top surface of the cover to indicate the function of the surface mount box, thus increasing the flexibility of use.

BRIEF DESCRIPTION OF THE DRAWINGS

Other objects, features, and advantages of the present invention will become apparent from the following detailed description of the preferred but non-limiting embodiments. The description is made with reference to the accompanying drawings in which.

DETAILED DESCRIPTION OF THE PREFERRED EMBODIMENTS

The surface mount box according to the preferred embodiment of the present invention comprises a cover 32 and a substrate 34.

Figure 1:
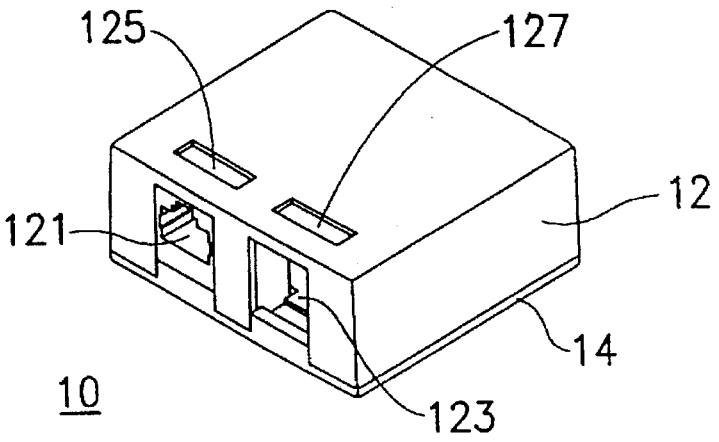
FIG. 1 (PRIOR ART)
FIG. 1 (prior art) is a perspective view illustrating a conventional containing box for transmission line connectors.
Figure 2:
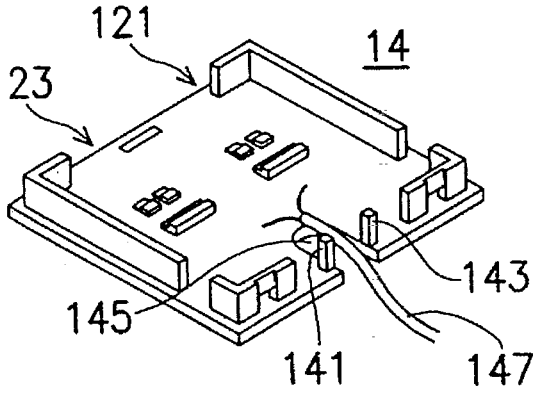
FIG. 2 (PRIOR ART)
FIG. 2 (prior art) is a perspective view illustrating the substrate portion of the containing box depicted in FIG. 1.
Figure 3:
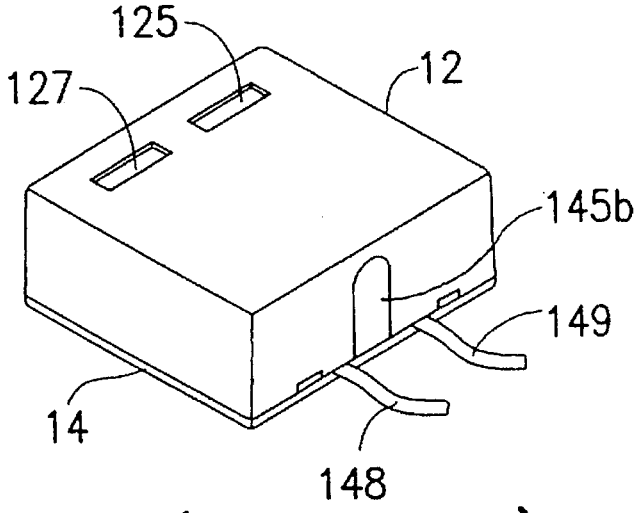
FIG. 3 (PRIOR ART)
FIG. 3 (prior art) is a schematic diagram illustrating two transmission lines crushed by the containing box of FIG. 1.
Figure 4A:
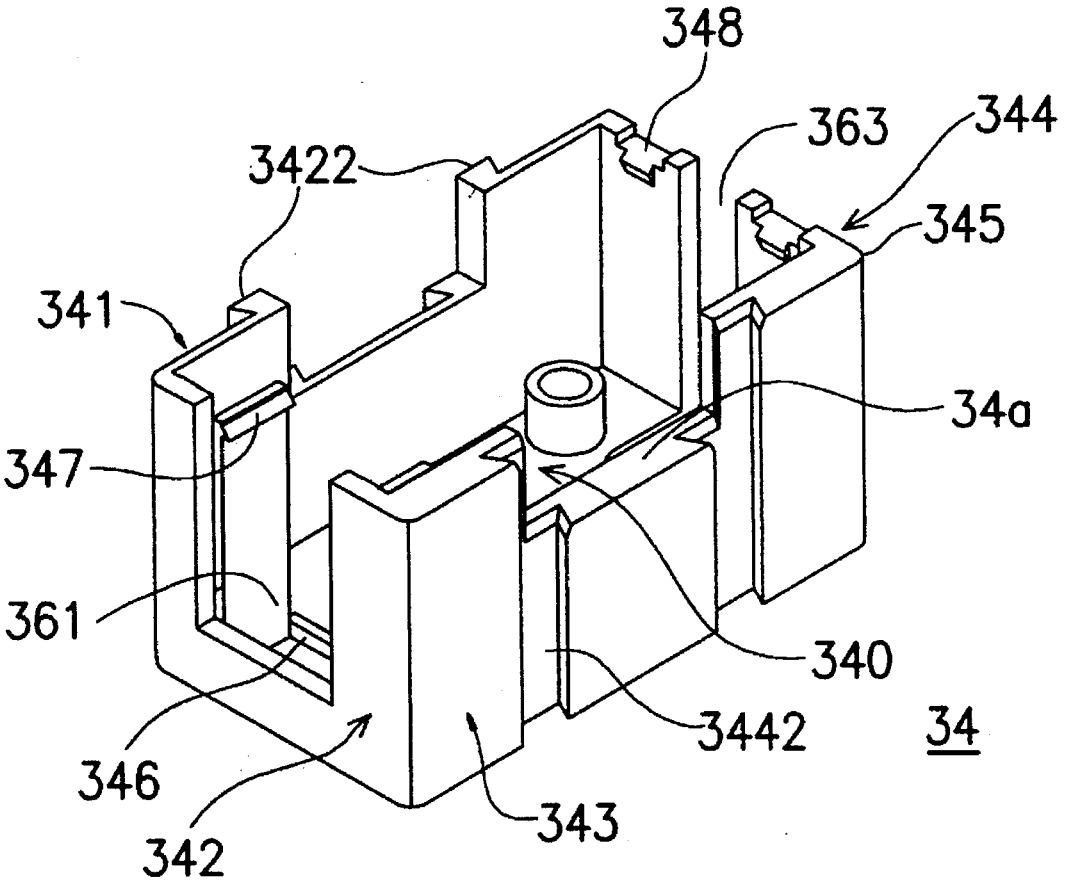
FIG. 4A through FIG. 4C are perspective views of the surface mount box according to one preferred embodiment of the present invention.

Referring to the FIG. 4A, substrate 34, which is substantially a rectangular box without cover, having four side walls 341 through 344 on a rectangular base 340 is illustrated. The four side walls, which encircle base 340 to form a hollow, include a first side wall 341, a second side wall 342 connecting to first side wall 341, a third side wall 343 opposite to first side wall 341 and a fourth side wall 344 connecting between first side wall 341 and third side wall 343. In order to increase the number of connector ports, first side wall 341 and its opposite side wall, i.e., third side wall 343, having coupling means on their exterior surfaces providing for connecting with other surface mount boxes. For example, at least one flange 3422 perpendicular to the base of the surface mount box is formed on a surface of first side wall 341, and at least one groove 3442 parallel to the flanges is formed on the third side wall 343. Since groove 3442 has a wider bottom than its opening, and flange 3422 has a narrower root, flange 3422 of one box can be exactly mated with groove 3442 of another box, thus securely connecting the two boxes together.

An opening 363 as a passage of the transmission line is formed on fourth side wall 344. In the present invention, since no other passage than opening 363 exists on the side wall, the transmission line can only enter the surface mount box through opening 363. Moreover, as opening 363 is deep, the transmission line can be easily aligned and installed therein. On top edge of fourth side wall 344, a number of coupling means 348 are provided for fastening cover 32.

As shown in the figure, an opening 361 for installing a first type connector port is formed on second side wall 342. A number of coupling means 346 and 347 are provided at edges of opening 361 to fasten the connector port.

Figure 4B:
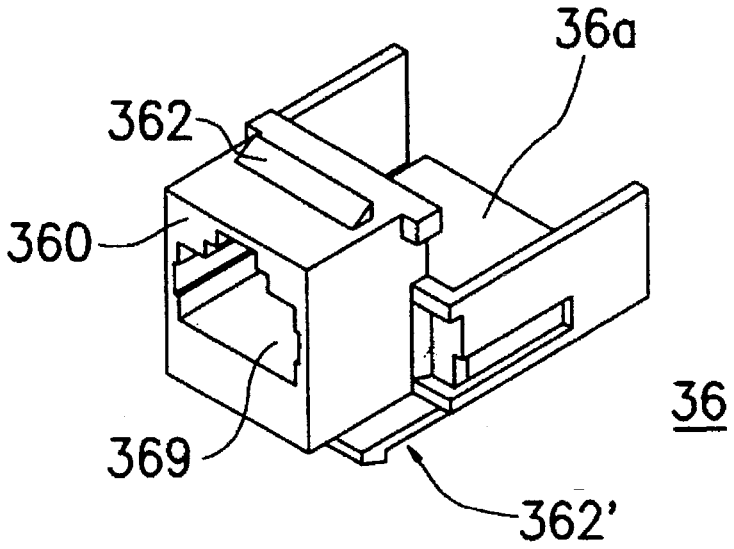

Referring to FIG. 4B, a connector port 36 which is suitable for installing in opening 361 of substrate 34 is illustrated. In order to avoid most structures being shielded by a board **36*a*, connector port 36 is illustrated upside-down in FIG. 4B. That is, board 36*a* should be turned to the topmost position when connector port 36 is about to be installed in substrate 34. Connector port 36 has a connector body 360 in which a cavity 369 for receiving a second type connector is formed. As shown in FIG. 4B, a coupling flange 362 on top surface of connector body 360 can couple with coupling means 346 of substrate 34. Connector body 360 is also provided with a coupling means 362' which has a prostrudent end to match coupling means 347 of substrate 34. Therefore, connector port 36 can be securely engaged with substrate 34. Connector port 36 may further include circuit board 36*a* to connect the transmission line and the connector body. The interconnection line pattern on circuit board 36*a*** has to be arranged specifically to reduce signal attenuation.

Figure 4C:
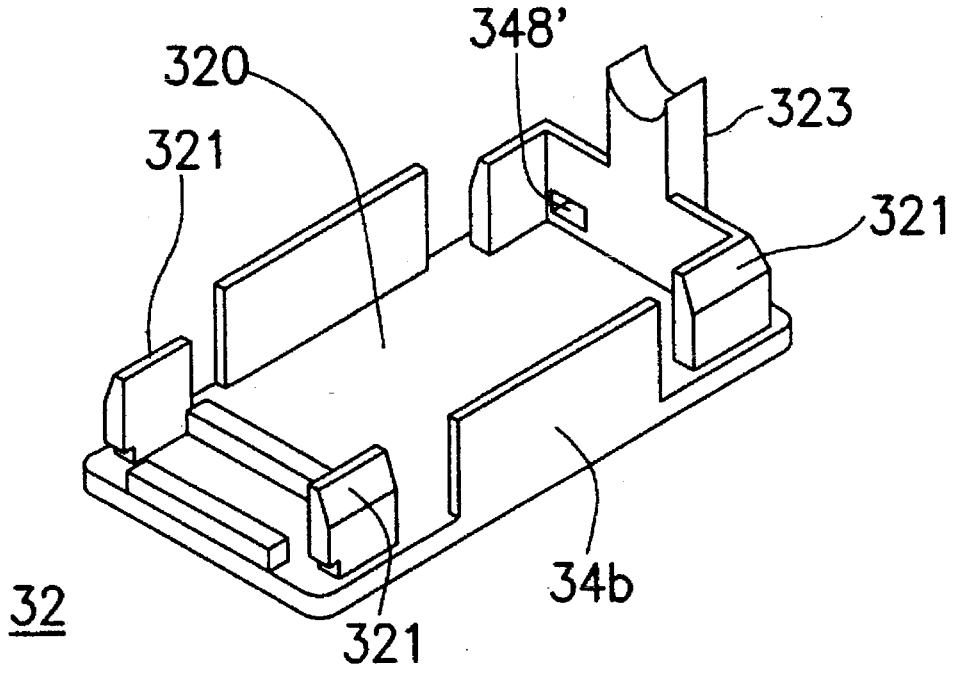

FIG. 4C is a perspective view of cover 32 which has been turned upside-down. As shown in the figure, cover 32 includes a base plate 320, a number of coupling elements 321, two side plates **34*b* and a plug 323. Coupling elements 321 tightly fasten cover 32 to substrate 34 when they are engaged. Referring to FIG. 4A, in order to facilitate mounting and/or dismounting two surface mount boxes, openings 34*a* are formed at central portions of first side wall 341 and third side wall 343. Therefore, cover 32 has to be provided with side plates 34*b* to cover openings 34*a*. Side plates 34*b* must be thinner than side walls 341 through 344 or they will affect the connection of coupling means 3422 and 3442**.

Figure 5:
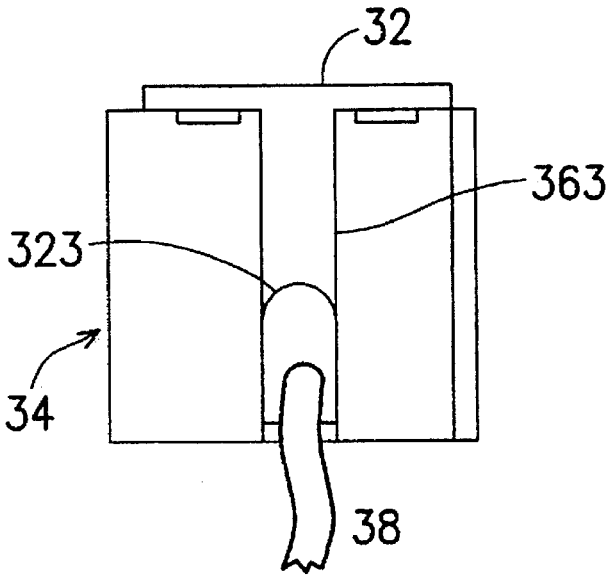
FIG. 5 is a side view of the surface mount box.

When cover 32 engages with substrate 34, plug 323 inserts into opening 363 to confine the transmission line within a small space. The width of plug 323 is not larger than the width of opening 363. FIG. 5 is a side view illustrating the situation when plug 323 of cover 32 is inserted into opening 363 of substrate 34. Since the transmission line 38 can be pushed into the bottom region of opening 363 by plug 323 when cover 32 engages with substrate 34, the transmission line 38 can be well confined within a small region and will not be crushed by any side plate or side wall of the box elements.

Figure 6:
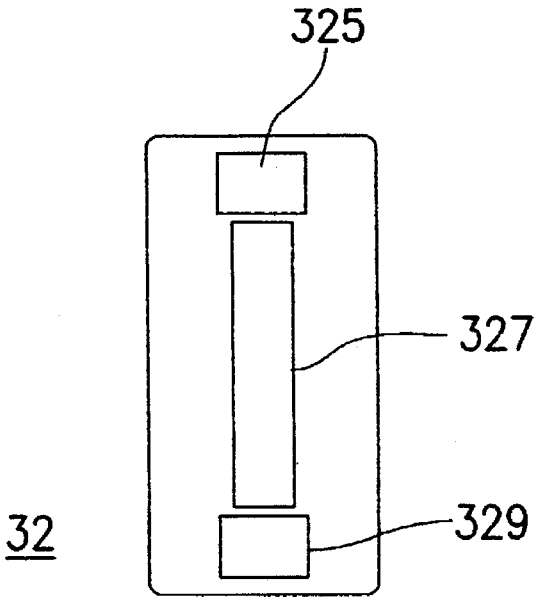
FIG. 6 is a top view of the cover shown in FIG. 4C.

Cover 32 can be further provided with a number of slots on a surface opposite to that containing the coupling elements 321, as shown in FIG. 6. These slots, including a function illustrating slot 325, a user illustrating slot 327 and a color illustrating slot 329, provide more information about the surface mount box than that of the prior art box. Function illustrating slot 325 shows the function of the surface mount box. In user illustrating slot 327, there can be a white paper for recording any information that the user wishes. Color illustrating slot 329 can contain a color card therein to show the property of the surface mount box. Therefore, through the information shown in slots 325, 327 and 329, the user can rapidly realize the usage of each surface mount box, thus facilitating the expansion of the boxes.

Figure 7:
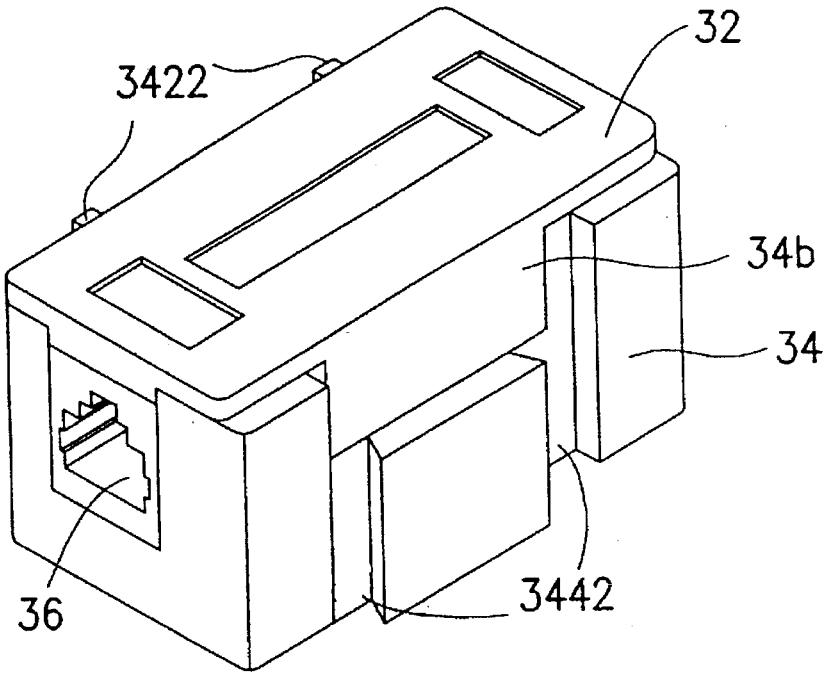
FIG. 7 is a perspective view illustrating the surface mount box of the present invention.
Figure 8:
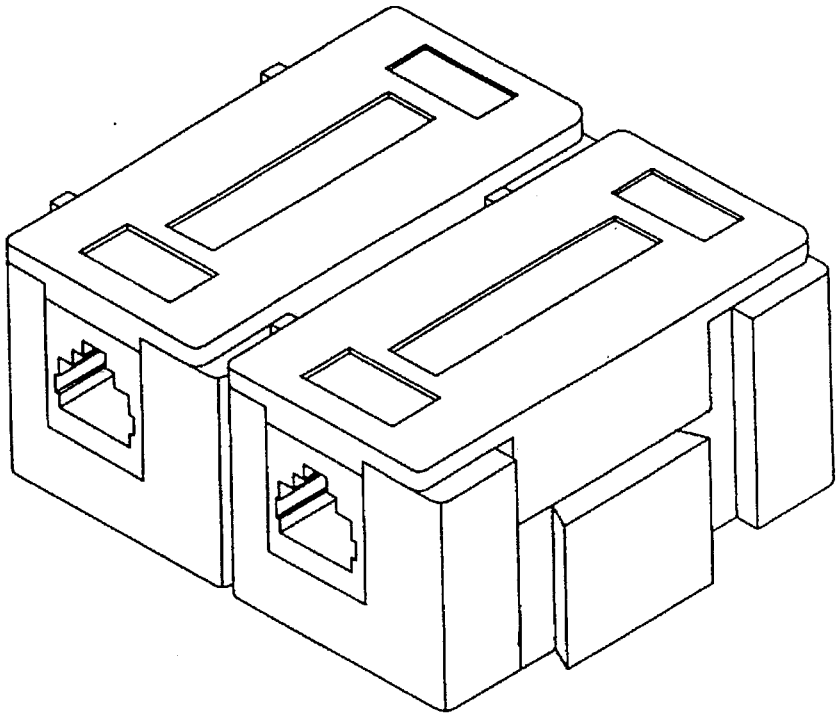
FIG. 8 illustrates two surface mount boxes of FIG. 7 connected together by connecting the coupling means on their side walls.

The complete surface mount box including substrate 34, cover 32 and connector port 36 is illustrated in FIG. 7. On side walls of the surface mount box, coupling means 3422 and 3442 are formed for connecting other surface mount boxes. For example, as shown in FIG. 8, the surface mount box is connected with a second expandable box by the coupling means. Since the top surfaces of the covers have various slots for indicating the functions of the surface mount boxes, the user will not be confused by the expanded boxes. Moreover, the number of expanded surface mount boxes can be increased as desired.

What is claimed is:

1. An expandable box for containing a connector port which is connected with a transmission line, said box comprising:

a substrate including:

a rectangular base;

a first side wall on one side of said base, having coupling means on the exterior surface for expansion;

a second side wall connecting with said first side wall on said base, having an opening for receiving said connector port;

a third side wall, opposite to said first side wall on said base, having coupling means on the exterior surface for expansion; and a fourth side wall, connecting between said first side wall and said third side wall on said base, having an opening as a passage for said transmission line;

a cover having a number of coupling elements and a plug on a base plate;

wherein said cover is fastened to said substrate by said coupling elements and said plug inserts into said opening of said fourth side wall to confine the transmission line therein.

2. The expandable box as claimed in claim 1, wherein said coupling means on the exterior surface of said first side wall include a flange.

3. The expandable box as claimed in claim 1, wherein said coupling means on the exterior surface of said third side wall include a groove.

4. The expandable box as claimed in claim 1, wherein said first side wall and said third side wall are provided with openings at their central portions.

5. The expandable box as claimed in claim 4, wherein said cover further comprises side plates on said base plate to cover said openings on said first side wall and said third side wall of said substrate.

6. The expandable box as claimed in claim 1, wherein said plug has a width not larger than that of said opening of said fourth side wall.

7. The expandable box as claimed in claim 1, wherein said cover is further provided with a plurality of slots on a surface opposite to the coupling elements.

8. The expandable box as claimed in claim 1, wherein said connector port includes a connector body and a plurality of coupling means on said connector body for connecting with said substrate.

9. The expandable box as claimed in claim 8, wherein said connector port further includes a circuit board to connect the transmission line and the connector body.

10. An expandable box for containing a connector port which is connected with a transmission line, said expandable box being expanded by connecting with a second expandable box, each said box comprising:

a substrate including:

a rectangular base;

a first side wall on one side of said base, having coupling means on the exterior surface for connecting with said second expandable box;

a second side wall connecting with said first side wall on said base, having an opening for receiving said connector port;

a third side wall, opposite to said first side wall on said base, having coupling means on the exterior surface for connecting with said second expandable box; and a fourth side wall, connecting between said first side wall and said third side wall on said base, having an opening as a passage for said transmission line;

a cover having a number of coupling elements and a plug on a base plate;

wherein said cover is fastened to said substrate by said coupling elements and said plug inserts into said opening of said fourth side wall to confine the transmission line therein.

11. The expandable box as claimed in claim 10, wherein said coupling means on the exterior surface of said first side wall include a flange.

12. The expandable box as claimed in claim 10, wherein said coupling means on the exterior surface of said third side wall include a groove.

13. The expandable box as claimed in claim 10, wherein said first side wall and said third side wall are provided with openings at their central portions.

14. The expandable box as claimed in claim 13, wherein said cover further comprises side plates on said base plate to cover said openings on said first side wall and said third side wall of said substrate.

15. The expandable box as claimed in claim 10, wherein said plug has a width not larger than that of said opening of said fourth side wall.

16. The expandable box as claimed in claim 10, wherein said cover is further provided with a plurality of slots on a surface opposite to the coupling elements.

17. The expandable box as claimed in claim 10, wherein said connector port includes a connector body and a plurality of coupling means on said connector body for connecting with said substrate.

18. The expandable box as claimed in claim 17, wherein said connector port further includes a circuit board to connect the transmission line and the connector body.

19. The expandable box as claimed in claim 8, wherein said plurality of coupling means on said connector body connect to corresponding coupling means provided on said second wall of said substrate.

20. The expandable box as claimed in claim 17, wherein said plurality of coupling means on said connector body connect to corresponding coupling means provided on said second wall of said substrate.

* * * * *